US006993478B2

(12) United States Patent
Thomson

(10) Patent No.: US 6,993,478 B2
(45) **Date of Patent: *Jan. 31, 2006**

(54) VECTOR ESTIMATION SYSTEM, METHOD AND ASSOCIATED ENCODER

(75) Inventor: Mark Thomson, Carlton (AU)

(73) Assignee: Motorola, Inc., Schaumburg, IL (US)

( * ) Notice: Subject to any disclaimer, the term of this patent is extended or adjusted under 35 U.S.C. 154(b) by 745 days.

This patent is subject to a terminal disclaimer.

(21) Appl. No.: 10/034,613

(22) Filed: Dec. 28, 2001

(65) Prior Publication Data

US 2003/0125937 A1 Jul. 3, 2003

(51) Int. Cl.
*G10L 19/04* (2006.01)

(52) U.S. Cl. ..... 704/221; 704/224; 704/225

(58) Field of Classification Search ..... 704/219, 704/221, 222, 224, 225, 226, 227, 228, 233, 704/234; 708/300, 308

See application file for complete search history.

(56) References Cited

U.S. PATENT DOCUMENTS 5,267,317 A * 11/1993 Kleijn ..... 704/217
5,517,595 A * 5/1996 Kleijn ..... 704/205
5,694,474 A * 12/1997 Ngo et al. ..... 381/66
5,761,383 A * 6/1998 Engel et al. ..... 706/14
5,884,253 A * 3/1999 Kleijn ..... 704/223
5,924,061 A * 7/1999 Shoham ..... 704/218
6,107,963 A * 8/2000 Ohmi et al. ..... 342/383
6,272,479 B1 * 8/2001 Farry et al. ..... 706/13
6,691,092 B1 * 2/2004 Udaya Bhaskar et al. .. 704/265
2002/0116184 A1 * 8/2002 Gottsman et al. ..... 704/220

OTHER PUBLICATIONS

Digalakis et al., "ML estimation of a stochastic linear system with the EM algorithm and its application to speech recognition," IEEE Transactions of Speech and Audio Processing, Oct. 1993, vol. 1, Issue 4, pp. 431 to 442.*

Gruber et al., "Estimation of quasiperiodic signal parameters by means of dynamic signal models," IEEE Transactions on Acoustics, Speech, and Signal Processing, Mar. 1994, vol. 42, Issue 3, pp. 552 to 562.*

(Continued)

*Primary Examiner*—Martin Lerner

(57) ABSTRACT

An encoder (60) and system (1) for processing a sequence of input vectors ($y_0$ to $y_T$) obtained from a speech signal. A filter (2) has both a current slowly evolving filter estimate output (6) and a previous slowly evolving filter estimate output (20). The current slowly evolving filter estimate output (6) provides vectors of current filtered estimate element values of a slowly evolving component of the sequence of input vectors ($y_0$ to $y_T$) and the previous slowly evolving filter estimate output (20) provides vectors of previous filtered estimate element values of the slowly evolving component of said sequence of input vectors ($y_0$ to $y_T$). There is also a parameter estimator (10), smoother module (17) and slowly evolving component encoder (65) that provides a digitized encoded slowly evolving component of the speech signal.

14 Claims, 5 Drawing Sheets

OTHER PUBLICATIONS

Nam Soo Kim, "Time-varying noise compensation using multiple Kalman filters," 1999 International Conference on Acoustics, Speech, and Signal Processing, Mar. 15-19, 1999, vol. 1, pp. 429 to 432.*

Bhaskar et al., "Quantization of SEW and REW components for 3.6 kbit/s coding based on PWI," 1999 IEEE Workshop of Speech Coding Proceedings, Jun. 20-23, 1999, pp. 99 to 101.*

Gottesman et al., "Enhanced waveform interpolative coding at low bit-rate," IEEE Transactions on Speech and Audio Processing, Nov. 2001, vol. 9, Issue 8, pp. 786 to 798.*

Lukasiak et al., "SEW representation for low rate WI coding," Proceedings ICASSP '01. 20th IEEE International Conference on Acoustics, Speech, and Signal Processing, 2001. May 7-11, 2001, vol. 2, pp. 697 to 700.*

* cited by examiner

VECTOR ESTIMATION SYSTEM, METHOD AND ASSOCIATED ENCODER

FIELD OF THE INVENTION

This invention relates to an encoder and a vector estimation system and method for processing a sequence of input vectors to determine a filtered estimate vector for each input vector. The invention is particularly useful for, but not necessarily limited to, determining filtered estimate vectors to be encoded by a speech encoder and transmitted over a communication link.

BACKGROUND ART

A digital speech communication or storage system typically uses a speech encoder to produce a parsimonious representation of the speech signal. A corresponding decoder is used to generate an approximation to the speech signal from that representation. The combination of the encoder and decoder is known in the art as a speech codec. As will be apparent to a person skilled in the art, many segments of speech signals contain quasiperiodic waveforms. Accordingly, consecutive cycles of quasiperiodic waveforms can be considered, and processed, by a speech codec as data vectors that evolve slowly over time.

An important element of a speech codec is the way it exploits correlation between consecutive cycles of quasiperiodic waveforms. Frequently, correlation is exploited by transmitting a single cycle of the waveform, or of a filtered version of the waveform, only once every 20–30 ms, so that a portion of the data is missing in the received signal. In a typical decoder the missing data is determined by interpolating between samples of the transmitted cycles.

In general, the use of interpolation by a speech decoder to generate data between the transmitted cycles only produces an adequate approximation to the speech signal if the speech signal really is quasiperiodic, or, equivalently, if the vectors representing consecutive cycles of the waveform evolve sufficiently slowly. However, many segments of speech contain noisy signal components, and this results in comparatively rapid evolution of the waveform cycles. In order for waveform interpolation in an encoder to be useful for such signals, it is necessary to extract a sufficiently quasiperiodic component from the noisy signal in the encoder. This extracted component may be encoded by transmitting only selected cycles and decoded by interpolation in the manner described above. The remaining noisy component may also be encoded using other appropriate techniques and combined with the quasiperiodic component in the decoder.

Linear low pass filtering a sequence of vectors representing consecutive cycles of speech in the time dimension is well known in the speech coding literature. The difficulty with this approach is that in order to get good separation of the slowly and rapidly evolving components, the low pass filter frequency response must have a sharp roll-off. This requires a long impulse response, which necessitates an undesirably large filter delay.

A Kalman filter technique for estimating quasiperiodic signal components has been described by Gruber and Todtli (IEEE Trans Signal Processing, Vol. 42, No. 3, March 1994, pp 552–562). However, because this Kalman filter technique is based on a linear dynamic system model of a frequency domain representation of the signal, it is unnecessarily complex. It also assumes that the dynamic system model parameters (i.e. noise energy and the harmonic signal gain) are known. However, when considering speech coding, noise energy and the harmonic signal gain parameters are not known.

A technique for determining the system parameters required in a Kalman filter using an Expectation Maximisation algorithm has been described in a more general setting by Digalakis et al (IEEE Trans Speech and Audio Processing, Vol. 1, No. 4, October 1993, pp 431–442). However, the technique is iterative, and in the absence of good initial estimates may converge slowly. It may also produce a result that is not globally optimal. No prior art method is known for obtaining good initial estimates. Further, this method typically requires a significant amount of data, over which the unknown parameters are constant. In the context of speech coding, where the parameters change continuously, rapid estimation is essential, and therefore this method of applying the Expectation Maximization algorithm needs to be improved.

Stachurski (PhD Thesis, McGill University, Montreal Canada, 1997) proposed a technique for estimating quasiperiodic signal components of a speech signal. This method involves minimizing a weighted combination of estimated noise energy and a measure of rate of change in the quasiperiodic component. This method is highly complex and does not allow the rate of evolution of the quasiperiodic component to be specified independently. Nor does it allow for an independently varying gain for the quasiperiodic component.

In this specification, including the claims, the terms comprises, comprising or similar terms are intended to mean a non-exclusive inclusion, such that a method or apparatus that comprises a list of elements does not include those elements solely, but may well include other elements not listed.

SUMMARY OF THE INVENTION

According to one aspect of the invention there is provided a vector estimation system for processing a sequence of input vectors, said input vectors each comprising a plurality of element values, and said system comprising:

a digital filter with a filter vector input for receiving said sequence of input vectors and a predictor gain input for controlling characteristics of said filter, said digital filter also having both a current slowly evolving filter estimate output and a previous slowly evolving filter estimate output, said current slowly evolving filter estimate output providing a current filtered estimate vector of current filtered estimate element values of a slowly evolving component of said sequence of input vectors and said previous slowly evolving filter estimate output providing a previous filtered estimate vector of previous filtered estimate element values of said slowly evolving component of said sequence of input vectors; and a parameter estimator having an estimator vector input for receiving said sequence of input vectors and a previous slowly evolving filter estimate input coupled to said previous slowly evolving filter estimate output, said parameter estimator further includes a predictor gain output coupled to said predictor gain input, wherein when said vector estimation system receives a current input vector that is one of said sequence of said input vectors, said parameter estimator provides a current predictor gain vector of current predictor gain element values at said predictor gain input each of said current predictor gain element values modifying one of said current filtered estimate element values at said current slowly evolving filter estimate output, each of said current predictor gain element values being dependent upon both said previous filtered estimate vector received at said slowly evolving filter estimate input and a said current input vector received at said estimator vector input.

Suitably, said parameter estimator may be characterised by said current predictor gain element values being dependent upon both a sequence of previous input vectors and a sequence of said previous filtered estimate vectors.

Preferably, said filter may have a predictor error variance output and an observation noise variance input, said predictor error variance output providing a current predictor error variance vector of current predictor error variance element values.

Suitably, when said vector estimation system receives said current input vector, said parameter estimator may provide a current observation noise variance vector of current observation noise variance element values at said observation noise variance output thereby modifying said current filtered estimate element values at said current slowly evolving filter estimate output, said current observation noise variance element values being dependent upon said previous filtered estimate vector received at said previous slowly evolving filter estimate input, said current input vector received at said estimator vector input, a said current predictor gain vector and said current predictor error variance vector.

Preferably, the parameter estimator may have an unvoiced speech module that determines the current input vector's harmonic energy content by assessing the current predictor gain element values and depending upon the current predictor gain element values the parameter estimator selectively sets the current observation noise variance values.

According to another aspect of the invention there is provided a vector estimation system for processing a sequence of input vectors, said input vectors each comprising a plurality of element values, and said system comprising:

a digital filter with a filter vector input for receiving said sequence of input vectors and an observation noise variance input for controlling characteristics of said filter, said digital filter also having a current slowly evolving filter estimate output, a predictor error variance output and a previous slowly evolving filter estimate output, said current slowly evolving filter estimate output providing a current filtered estimate vector of current filtered estimate element values of a slowly evolving component of said sequence of input vectors, said predictor error variance output providing a current predictor error variance vector of current predictor error variance element values and said previous slowly evolving filter estimate output providing a previous filtered estimate vector of previous filtered estimate element values of said slowly evolving component of said sequence of input vectors; and a parameter estimator having an estimator vector input for receiving said sequence of input vectors and a previous slowly evolving filter estimate input coupled to said previous slowly evolving filter estimate output, said parameter estimator further includes a observation noise variance output coupled to said observation noise variance input and a predictor error variance input coupled to said predictor error variance output, wherein when said vector estimation system receives a current input vector that is one of said sequence of said input vectors, said parameter estimator provides a current observation noise variance vector of current observation noise variance element values at said observation noise variance input each of said current observation noise variance element values modifying one of said current filtered estimate element values at said current slowly evolving filter estimate output, each of said current observation noise variance element values being dependent upon a said current input vector, a said current predictor error variance vector and a said previous filtered estimate vector.

Preferably, the parameter estimator may have an unvoiced speech module that determines the current input vector's harmonic energy content by assessing the current predictor gain element values and depending upon the current predictor gain element values the parameter estimator selectively sets the current observation noise variance values.

Suitably, said digital filter may further include: a slowly evolving predicted estimate output providing a current predicted estimate vector of current predicted estimate element values of said slowly evolving component of said sequence of input vectors. The digital filter may also have a process noise variance input.

Suitably, there may be a smoother module having inputs coupled respectively to at least two outputs of said digital filter.

Preferably, said smoother module may have five inputs coupled to respective outputs of said filter. Preferably, said smoother module may have a smoothed estimate output providing a smoothed estimate value of a previous slowly evolving component.

Suitably, said smoothed estimate output is coupled to a smoothed estimate input of said parameter estimator.

According to another aspect of the invention there is provided a method for processing a sequence of input vectors each comprising a plurality of elements, said vectors being applied to a vector estimation system having a parameter estimator coupled to a digital filter, said method comprising the steps of:

receiving said sequence of input vectors at inputs of said filter and said parameter estimator, said input vectors comprising a plurality of element values;

determining a current predictor gain vector of current predictor gain element values, each of said current predictor gain element values being determined from a said current input vector that is one of said sequence of said input vectors, said determining being effected by said parameter estimator; and applying said current predictor gain element values to said digital filter to thereby modify a current filtered estimate vector of current filtered estimate element values provided at an output of said digital filter, each of said current predictor gain element values being dependent upon a previous filtered estimate vector from said filter and said current input vector.

Preferably, said step of determining may be further characterised by providing a current observation noise variance vector of current observation noise variance element values and a current predictor error variance vector of current predictor error variance element values from said current input vector.

Suitably, said step of applying may be further characterised by said filter receiving said current observation noise variance element values thereby modifying said current filtered estimate element values, each of said current observation noise variance element values being dependent upon a said previous filtered estimate vector, said current input vector, a said current predictor gain element vector and said current predictor error variance vector.

According to another aspect of the invention there is provided a method for processing a sequence of input vectors each comprising a plurality of elements, said vectors being applied to a vector estimation system having a parameter estimator coupled to a digital filter, said method comprising the steps of:

receiving said sequence of input vectors at inputs of said filter and said parameter estimator, said input vectors comprising a plurality of element values;

determining a current observation noise variance vector of current observation noise variance element values, each of said current observation noise variance element values being determined from said current input vector that is one of said sequence of said input vectors, said determining being effected by said parameter estimator; and applying said current observation noise variance element values to said digital filter to thereby modify a current filtered estimate vector of current filtered estimate values provided at an output of said digital filter, each of said current observation noise variance element values being dependent upon a said current input vector, a vector comprising current predictor error variance element values, and a vector of previous filtered estimate element values.

Preferably, the filter may be a Kalman filter.

According to another aspect of the invention there is provided an encoder for processing a speech signal, said encoder comprising:

a signal normalization module for processing the speech signal to provide a sequence of input vectors each comprising a plurality of element values;

a digital filter with a filter vector input coupled to an output of the signal normalization module for receiving said sequence of input vectors, the digital filter also having an observation noise variance input for controlling characteristics of said filter, said digital filter also having a current slowly evolving filter estimate output, a predictor error variance output and a previous slowly evolving filter estimate output, said current slowly evolving filter estimate output providing a current filtered estimate vector of current filtered estimate element values of a slowly evolving component of said sequence of input vectors, said predictor error variance output providing a current predictor error variance vector of current predictor error variance element values and said previous slowly evolving filter estimate output providing a previous filtered estimate vector of previous filtered estimate element values of said slowly evolving component of said sequence of input vectors; and a parameter estimator having an estimator vector input for receiving said sequence of input vectors and a previous slowly evolving filter estimate input coupled to said previous slowly evolving filter estimate output, said parameter estimator further includes a observation noise variance output coupled to said observation noise variance input and a predictor error variance input coupled to said predictor error variance output, wherein when said vector estimation system receives a current input vector that is one of said sequence of said input vectors, said parameter estimator provides a current observation noise variance vector of current observation noise variance element values at said observation noise variance input each of said current observation noise variance element values modifying one of said current filtered estimate element values at said current slowly evolving filter estimate output, each of said current observation noise variance element values being dependent upon a said current input vector, said current predictor error variance vector and said previous filtered estimate vector.

Preferably, the encoder may include an adder module with one input coupled to said slowly evolving filter estimate output and another input coupled to the output of the signal normalization module, wherein in use said adder subtracts the said current filtered estimate element values at the output of the vector estimation system from at least one of the elements of the sequence of input vectors.

Suitably, an output of the adder module may be coupled to a rapidly evolving component encoder.

Suitably, said parameter estimator may be characterised by said current predictor gain element values being dependent upon both a sequence of previous input vectors and a sequence of filtered estimate vectors.

BRIEF DESCRIPTION OF THE DRAWINGS

In order that the invention may be readily understood and put into practical effect, reference will now be made to a preferred embodiment as illustrated with reference to the accompanying drawings in which.

DETAILED DESCRIPTION OF THE PREFERRED EMBODIMENT OF THE INVENTION

Figure 1:
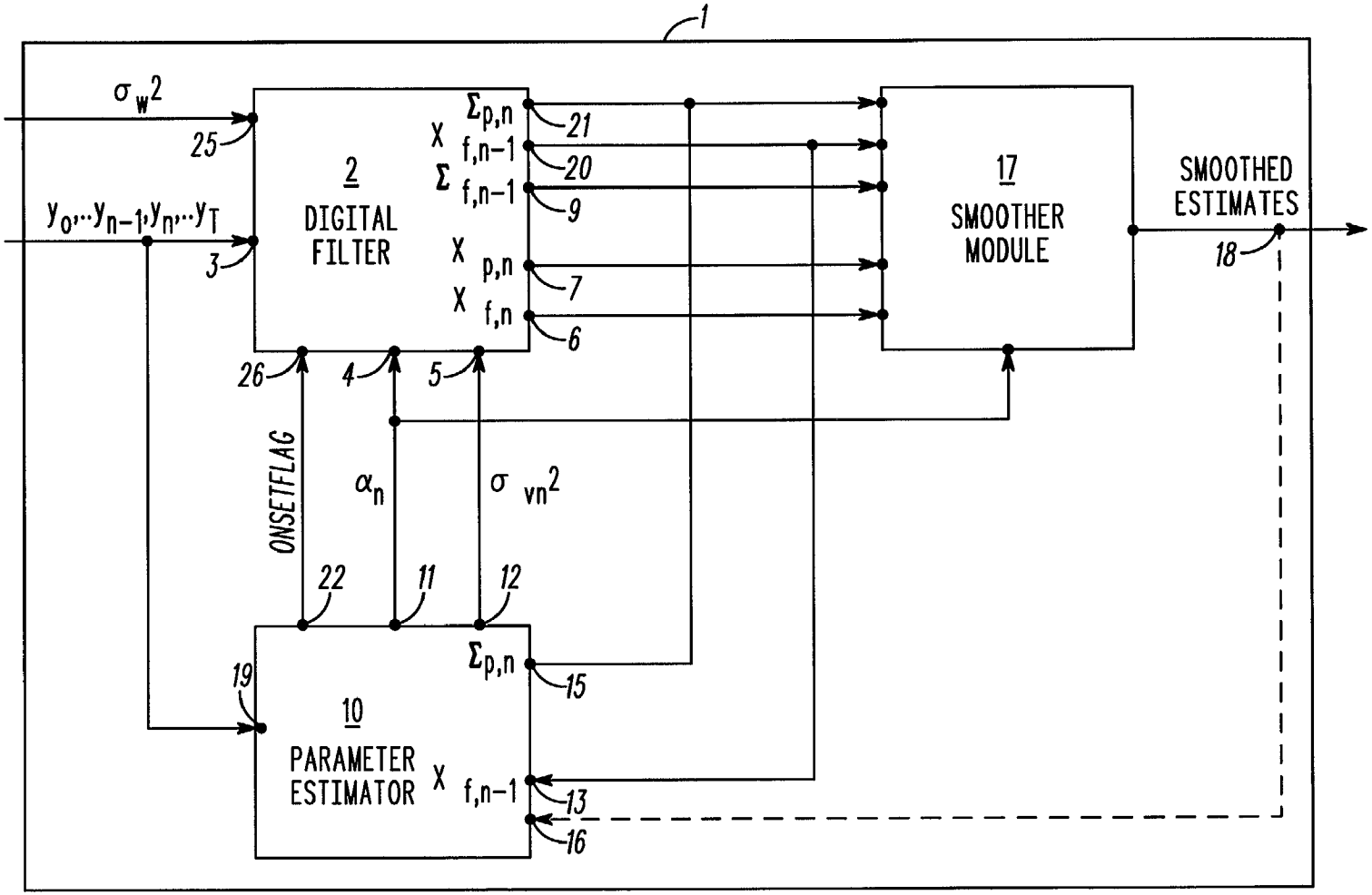
FIG. 1 illustrates a vector estimation system for processing a sequence of input vectors in accordance with a preferred embodiment of the invention.

In the drawings, like numerals on different Figs are used to indicate like elements throughout. Referring to FIG. 1, there is illustrated a vector estimation system 1 for processing a sequence of input vectors ($y_0$ to $y_T$) each of the input vectors comprising a plurality of element values $y_{n,\ i}$. The vector estimation system 1 includes a digital filter 2, a parameter estimator 10 and a smoother module 17. The digital filter 2 has five inputs and five outputs. The five inputs of the digital filter 2 are a filter vector input 3, a predictor gain input 4, an observation noise variance input 5, an OnsetFlag input 26 and process noise variance input 25. The five outputs of the digital filter 2 are a current slowly evolving filter estimate output 6, a current slowly evolving predicted estimate output 7, a previous filter error variance output 9, a previous slowly evolving filter estimate output 20 and a current predictor error variance output 21.

The parameter estimator 10 has four inputs and three outputs. The parameter estimator 10 inputs are an estimator vector input 19 coupled to the vector input 3; a previous slowly evolving filter estimate input 13 coupled to the previous slowly evolving filter estimate output 20; a current predictor error variance input 15 coupled to the current predictor error variance output 21; and a smoothed estimate input 16. The three outputs of the parameter estimator 10 are a predictor gain output 11 coupled to the predictor gain input 4; an observation noise variance output 12 coupled to the observation noise variance input 5; and an OnsetFlag output 22 coupled to the OnsetFlag input 26.

The smoother module 17 has six inputs one being coupled to the slowly evolving filter estimate output 6; one coupled to the slowly evolving predicted estimate output 7; one coupled to the previous filter error variance output 9; one coupled to the previous slowly evolving filter estimate output 20; one coupled to the predictor error variance output 21; and one coupled to the predictor gain output 11. The smoother module 17 also has a smoothed estimate output 18 providing an output for the vector estimation system 1, the smoothed estimate output 18 is coupled to the smoothed estimate input 16 of the parameter estimator 10.

Figure 2:
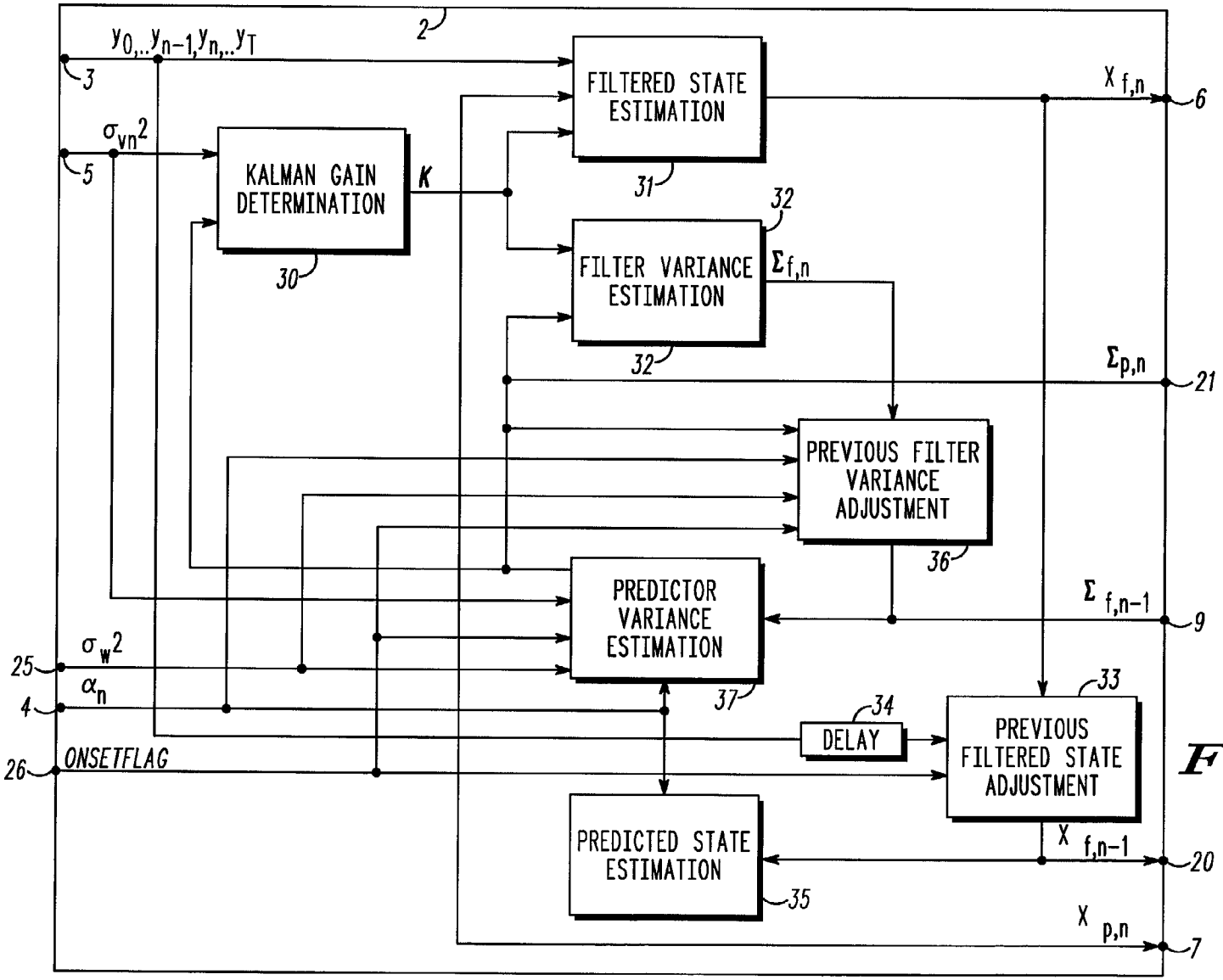
FIG. 2 illustrates a digital filter forming part of the vector estimation system of FIG. 1.

Referring to FIG. 2, the digital filter 2 is a comb filter in the form of a Kalman Filter Bank. The digital filter 2 comprises a Kalman gain determination module 30 with one input being the observation noise variance input 5. There is also a filtered state estimation module 31 with one input being the vector input 3 and another input being coupled to an output of the Kalman gain determination module 30. An output from the filtered state estimation module 31 provides the slowly evolving filter estimate output 6 that is coupled to an input of a previous filtered state adjustment module 33. Other inputs of the previous filtered state adjustment module 33 are provided by the OnsetFlag input 26 and the vector input 3 via a delay module 34.

An output from the previous filtered state adjustment module 33 provides the previous slowly evolving filter estimate output 20 that is coupled to an input of a predicted state estimation module 35. Another input to the predicted state estimation module 35 is provided by the predictor gain input 4. An output of the predicted state estimation module 35 provides the slowly evolving predicted estimate output 7 that is coupled to an input of the filtered state estimation module 31.

The output from the Kalman gain determination module 30 is also coupled to an input of a filter variance estimation module 32 that has an output coupled to an input to a previous filter variance adjustment module 36. An output from the previous filter variance adjustment module 36 provides the previous filter error variance output 9 that also provides an input to a predictor variance estimation module 37. Other inputs to the predictor variance estimation module 37 are provided by the predictor gain input 4, process noise variance input 25, OnsetFlag input 26 and observation noise variance input 5. An output from the predictor variance estimation module 37 provides the predictor error variance output 21 that is coupled to inputs of the Kalman gain determination module 30, the filter variance estimation module 32 and previous filter variance adjustment module 36. Other inputs to the previous filter variance adjustment module 36 are provided by the predictor gain input 4, the process noise variance input 25 and the OnsetFlag input 26.

As will be apparent to a person skilled in the art, the characteristics of the digital filter 2 are formalised in equations (1)–(6) below.

At an nth input vector $y_n$ (a current input vector) of the series of input vectors ($y_0$ to $y_T$) received by the system 1, the previous filtered state adjustment module 33 provides, at the previous slowly evolving filter estimate output 20, a previous filtered estimate vector $x_{f,n-1}$ of previous filtered estimate element values $x_{f,n-1,i}$.

The OnsetFlag input 26 is a binary signal input that indicates whether or not the beginning of a signal segment containing a significant amount of harmonic energy (determined by a threshold value) has been detected. If OnsetFlag input 26 is set to a value that indicates that the beginning of such a segment has been detected, then the previous filtered estimate vector $x_{f,n-1}$ is set to a previous input vector $y_{n-1}$.

For the current input vector $y_n$, the digital filter 2 provides a current predicted estimate vector $x_{p,n}$ of current predicted estimate element values $x_{p,n,i}$ at the predicted estimate output 7. Each of the current predicted estimate element values $x_{p,n,i}$ are computed according to:

$$x_{p,n,i}=\alpha_{n,i}\cdot x_{f,n-1,i} \tag{1}$$

Where i is an index identifying an element of a vector; and $\alpha_{n,i}$ is a current predictor gain element value of a current predictor gain vector $\alpha_n$ for an ith element in the nth input vector $y_n$, provided at the predictor gain input 4.

Once the current predicted estimate vector $x_{p,n}$ is computed, then also for the current input vector $y_n$ a current filtered estimate vector $x_{f,n}$ of current filtered estimate element values $x_{f,n,i}$ is provided at the slowly evolving filter estimate output 6 Each of the current filtered estimate element values $x_{f,n,i}$ are computed according to:

$$x_{f,n,i}=x_{p,n,i}+k_{n,i}\cdot(y_{n,i}x_{p,n,i}) \tag{2}$$

Where $K_{n,i}$ is a current Kalman gain element value in a current Kalman gain vector $K_n$ for the digital filter 2 for the ith element of the nth current input vector $Y_n$.

The Kalman gain element value $K_{n,i}$ is computed according to:

$$K_{n,i}=\Sigma_{p,n,i}/(\Sigma_{p,n,i}+\sigma_{v}{}^{n}{}_{,i}{}^{2}) \tag{3}$$

Where, $\Sigma_{p,n,i}$ is a current predictor error variance element value in a current predictor error variance vector $\Sigma_{p,n}$ provided at the predictor error variance output 21 for the ith element of the nth input vector $y_n$; and $\sigma_{v_n,i}{}^2$ is a current observation noise variance element value in a current observation noise variance vector $\sigma_{v_n}{}^2$ provided at the observation noise variance input 5 also for the ith element of the nth input vector $y_n$.

If the OnsetFlag is set to a value that indicates that the beginning of a signal segment containing a significant amount of harmonic energy has been detected, then the current predictor error variance vector $\Sigma_{p,n}$ is typically set to the observation noise variance vector $$\sigma_{v_n}^2.$$

This results in Equation (3) producing the current Kalman gain element value $K_{n,i}$ equal to 0.5 for all elements of the Kalman gain vector $K_n$.

If the OnsetFlag is set to a value that indicates that the beginning of a signal segment containing a significant amount of harmonic energy has not been detected, then the current predictor error variance element values $\Sigma_{p,n,i}$ are computed according to:

$$\Sigma_{p,n,i}=\alpha_{n,i}\cdot\alpha_{n,i}\cdot\Sigma_{f,n-1,i}+\sigma_{w}{}^{2} \tag{4}$$

where $\sigma_w{}^2$ is a process noise variance value provided at the process noise variance input 25; and $\Sigma_{f,n-1,i}$ is a previous filtered error variance element value in a previous filtered error variance vector $\Sigma_{f,n-1}$ for the ith element of a previous input vector $y_{n-1}$.

If the OnsetFlag is set to a value that indicates that the beginning of a signal segment containing a significant amount of harmonic energy has not been detected then a current filtered error variance element value $\Sigma_{f,n,i}$ of a current filtered error variance vector $\Sigma_{f,n}$ provided at the output of the filter error variance estimation module 32, is computed according to:

$$\Sigma_{f,n,i}=(1-K_{n,i}).\Sigma_{p,n,i} \tag{5}$$

If the OnsetFlag is set to a value that indicates that the beginning of a signal segment containing a significant amount of harmonic energy has been detected, then each current filtered error variance element value $\Sigma_{f,n,i}$ is computed according to:

$$\Sigma_{f,n,i}=(\Sigma_{p,n,i}-\sigma_w^2)/\alpha_{n,i}^2 \tag{6}$$

Figure 3:
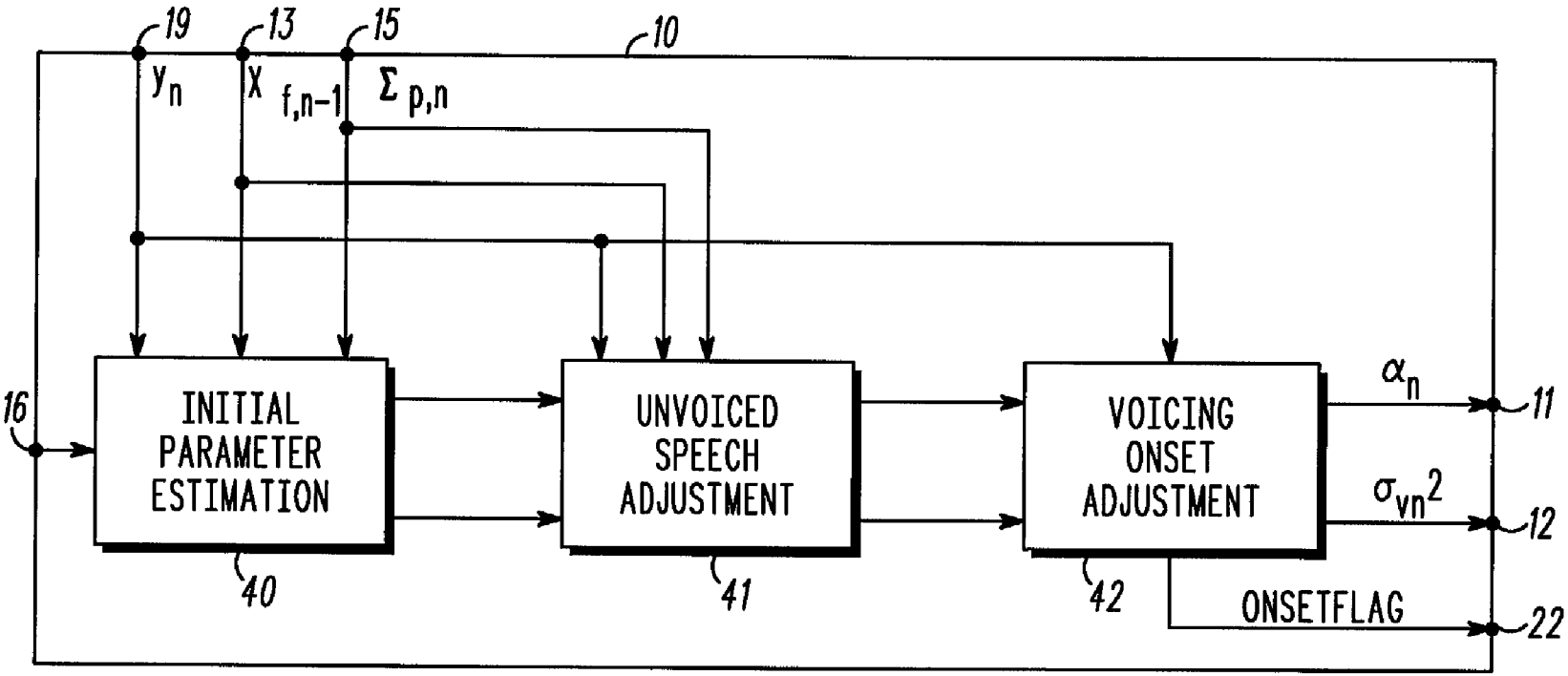
FIG. 3 illustrates a parameter estimator forming part of the vector estimation system of FIG. 1.

Referring to FIG. 3 there is illustrated the parameter estimator 10 that typically comprises an initial parameter estimation module 40, an unvoiced speech adjustment module 41 and a voicing onset adjustment module 42. The initial parameter estimation module 40 has four inputs provided by the predictor error variance input 15, the previous slowly evolving filter estimate input 13, the vector input 19 and the smoothed estimate input 16. Outputs of the initial parameter estimation module 40 are coupled to inputs of the unvoiced speech adjustment module 41 and further inputs to module 41 are provided by the predictor error variance input 15, the previous slowly evolving filter estimate input 13 and the vector input 19. Outputs of the unvoiced speech adjustment module 41 are coupled to inputs the voicing onset adjustment module 42 and a further input to module 42 is provided by the vector input 3. The voicing onset adjustment module 42 has three outputs providing the predictor gain output 11, observation noise variance output 12 and OnsetFlag output 22.

The initial parameter estimation module 40 computes initial estimates of the current predictor gain element values $\alpha_{n,i}$ and the current observation noise variance element values $\sigma_{vn,i}^2$. These are determined as follows:

$$\alpha_{n,i}=\alpha_n(i,a_{n,0}, \ldots a_{n,m_a-1}) \tag{7a}$$

$$\sigma_{v,n,i}^2 = \sigma_{v_n}^2(i, b_{n,0}, \ldots b_{n,m_b-1}) \tag{8a}$$

where $a_{n,0} \ldots a_{n,m_a-1}$ and $b_{n,0} \ldots b_{n,m_b-1}$ are the parameters of the respective current predictor gain element values $\alpha_{n,i}$ and current observation noise variance element values $\sigma_{v_n,i}^2$, these parameters are assumed to be constant for each vector (each value of n). The number of parameters for $a_n$ is defined by the index $m_a$ and the number of parameters for $b_n$ is defined by the index $m_b$. The index i ranges from 1 to N within each vector. Since consecutive vectors represent adjacent cycles of the waveform, an element with index i=0 for an nth vector also represents the element with index i=N for the (n−1)th vector.

In general, the functions in (7a) and (8a) may take on a variety of forms. In one preferred embodiment, where indexes $m_a$ and $m_b$ equal 2, the parameter estimator 10 computes estimates of the current predictor gain element values $\alpha_{n,i}$ and the current observation noise variance element values $\sigma_{v_n,i}^z$ as follows:

$$\alpha_{n,i}=a_{n,0}+a_{n,1}.i/N \tag{7b}$$

$$\sigma_{v_n,i}^2 = (b_{n,0} + b_{n,1} \cdot i/N)^2 \tag{8b}$$

It may be assumed that smoothness constraints apply to $\alpha_{n,i}$ and $$\sigma_{v_n,i}^2$$

at boundaries between each cycle (input vector). We may assume, for example, that the function $\alpha_n(i,a_{n,0} \ldots a_{n,m_a-1})$ evaluated at i=0 is the same as $\alpha_{n-1}(i,a_{n-1,0}, \ldots a_{n-1,m_a-1})$ at i=N, and that $$\sigma_{v_n}^2(i, a_{n,0}, \ldots a_{n,m_a-1})$$

evaluated at i=0 is the same as $$\sigma_{v_{n-1}}^2(i, a_{n-1,0}, \ldots a_{n-1,m_a-1})$$

at i=N. Hence $a_{n,0}$ is equal to $\alpha_{n-1,N}$, and $b_{n,0}$ is equal to $$\sqrt{\sigma_{v_{n-1},N}^2}.$$

Furthermore, $a_{n,1}$ is calculated using the below equation (9) as follows:

$$a_{n,1} = \frac{N \cdot \sum_{i=1}^{P} [y_{n,i} \cdot x_{f,n-1,i} - a_0 \cdot [x_{f,n-1,i}]^2]}{\sum_{i=1}^{P} [x_{f,n-1,i}]^2} \tag{9}$$

And the parameter $b_{n,1}$ is calculated by substituting equation (8b) into the below equation (10).

$$\frac{1}{N}\sum_{i=1}^{N} \frac{(y_{n,i}^2 - y_{n,i}x_{f,n,i})}{\sigma_{v_n,i}^2} = 1 \tag{10a}$$

In order to determine $b_{n,1}$ we need to substitute $$\sigma_{v_n,i}^2$$

by using equation (8b) and then substitute for $x_{f,n,i}$ by using equations (2) and (3). This results in the following equation (10b):

$$\frac{1}{N}\sum_{i=1}^{N}\left\{\left(y_{n,i}^2 - y_{n,i}\left[\alpha_{n,i} \cdot x_{f,n-1,i} + \frac{\sum_{p,n,i}}{(\sum_{p,n,i} + (b_{n,0} + b_{n,1} i/N)^2)} \cdot (y_{n,i} - \alpha_{n,i}x_{f,n-1,i})\right]\right) \Big/ \sigma_{v_n,i}^2\right\} = 1 \tag{10b}$$

As will be apparent to a person skilled in the art, from equation (10b), $b_{n,1}$ can be determined by an iterative method, such as the Newton-Raphson algorithm.

The unvoiced speech adjustment module 41 determines whether the current input vector $y_n$ represents a segment of speech that contains no significant harmonic energy, and if so selectively sets the current predictor gain vector $\alpha_n$ and the current observation noise variance vector $$\sigma^2_{v_{n,i}}$$

appropriately. Preferably, the unvoiced speech adjustment unit determines that the current input vector $y_n$ represents a segment of speech that contains no significant harmonic energy by detecting whether either of the following conditions is true:

(i) $\alpha_{n,i}$ is less than 0.0; or (ii) both $\alpha_{n,i}$ is greater than 1.0 and the initial estimation of the observation noise variance value is greater than mean squared value of elements in the current predicted estimate value.

If either conditions (i) or (ii) hold, then typically the unvoiced speech adjustment module 41 will set $\alpha_{n,i}$ to 1.0, and re-compute $$\sigma^2_{v_{n,i}}$$

accordingly using Equation (8).

The voicing onset adjustment module 42 determines if the current input vector $y_n$ represents the second cycle of a segment of speech containing a significant amount of harmonic energy, and if so adjusts current predictor gain element values $\alpha_{n,i}$ and the observation noise variance element values $$\sigma^2_{v_{n,i}}$$

to more appropriate values and sets the OnsetFlag to a value indicating that voicing onset has been detected.

Typically, the voicing onset adjustment module 42 determines that the current input vector $Y_n$ is the second cycle of a segment of speech containing a significant amount of harmonic energy as follows. An input prediction gain, $\beta$, is computed according to:

$$\beta=(y_n^T.y_{n-1})/(y_{n-1}^T.y_{n-1}) \tag{11}$$

Input prediction error variance values, $\sigma_{e,i}^2$, are computed according to:

$$\sigma_{e,i}^2=y_{n,}^T.(y_{n,i}-\beta.y_{n-1})/N \tag{12}$$

where $\sigma_{e,i}^2$ is the same for all elements in the vector $\sigma_e^2$.

The voicing onset adjustment unit determines whether both of the following conditions are true:

(iii) $\sigma_{e,i}^2$ is less than $k_1$.

$$\sigma^2_{v_{n,i}},$$

wherein $k_1$ is a constant, whose value is typically 0.9.

(iv) $\sigma_{e,i}^2$ divided by the mean squared value of the elements of the input vector is less than $k_2$, wherein $k_2$ is a constant, whose value is typically 0.5.

If both conditions (iii) and (iv) hold, then typically the voicing onset adjustment unit will set $\alpha_{n,i}$ to $\beta$ and set $$\sigma^2_{v_{n,i}}$$

to $\sigma_{e,i}^2$.

Figure 4:
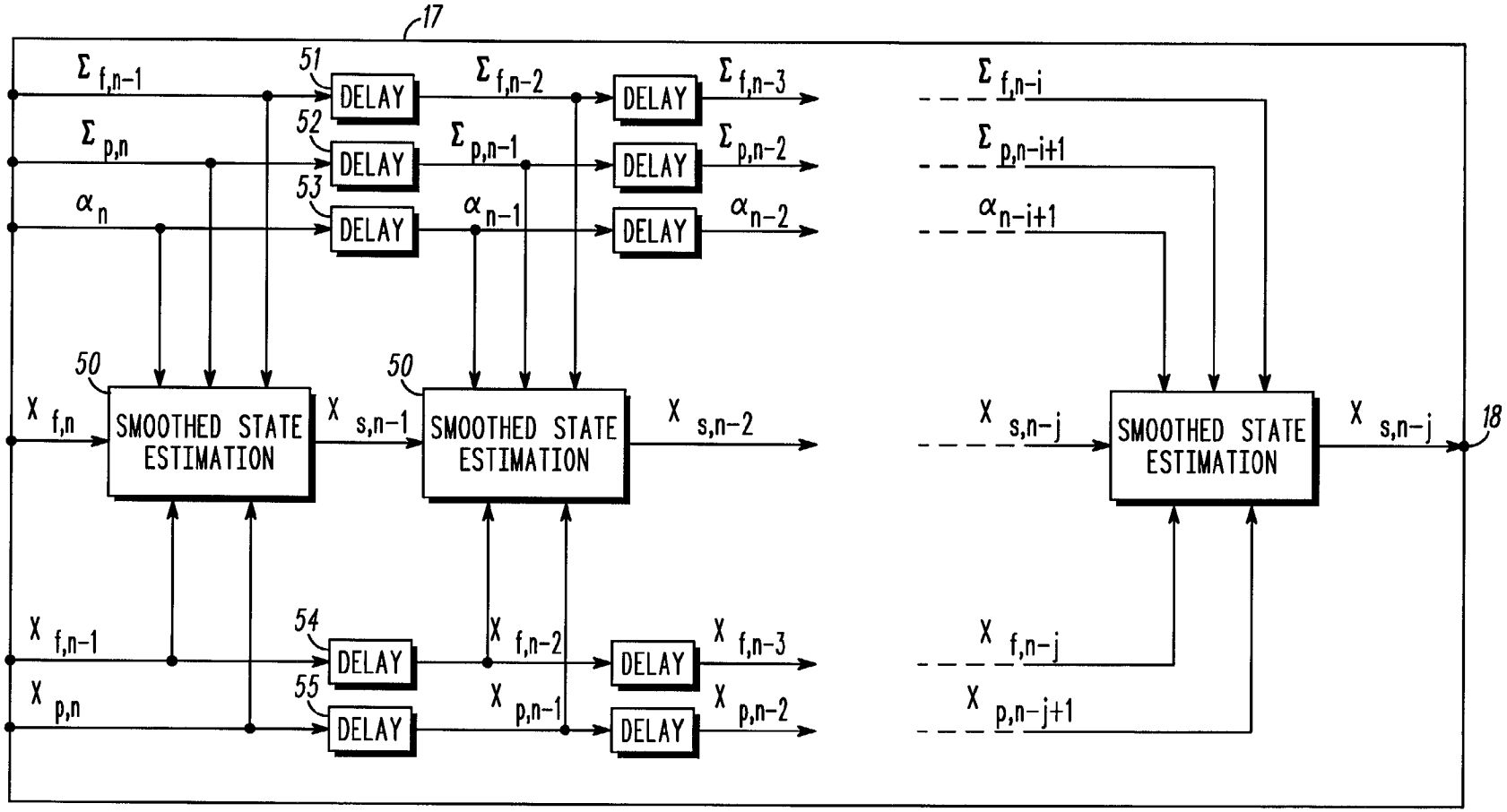
FIG. 4 illustrates a smoother module forming part of the vector estimation system of FIG. 1.

Referring to FIG. 4 there is illustrated the smoother module 17 that typically comprises series coupled smoothed state estimation modules 50 a first stage of which has an input receiving the current filtered estimate value $x_{f,n}$. The final stage of the smoothed state estimation module 50 provides a smoothed estimate value $x_{f,n-j}$ at output 18 of a previous slowly evolving component. The smoother module 17 also has five sets of series coupled delay modules 51, 52, 53, 54 and 55 with respective outputs of an jth delay module 51, 52, 53, 54 and 55 providing inputs to an j+1th smoothed state estimation module 50.

The smoothed state estimation modules 50 provide smoothed estimates $X_{S,(n-j),i}$ for successive values of j beginning with j=1. These estimates are computed according to:

$$X_{s,(n-j),i}=x_{f,(n-j),i}+C.(x_{s,(n-j+1),i}-X_{p,(n-l),i}) \tag{13}$$

wherein $$C=(\Sigma_{f,n-j,i}.\alpha_{n-j,i}/\Sigma_{p,(n-j+1,i)}) \tag{14}$$

and $$X_{s,n,i}=X_{f,n,i} \tag{15}$$

From the above it will be apparent that the purpose of the smoother module 17 is to provide an estimate $X_{s,(n-j)}$ of the slowly evolving component of an input vector $y_{n-j}$ based upon input vectors up to and including $y_n$. The smoother module 17 thus uses current data to estimate a past slowly evolving component value, in contrast to the digital filter 2, which uses current data to estimate a current slowly evolving component value.

In use, the vector estimation system 1 receives the sequence of input vectors $y_0$ to $y_T$ that are each comprising N elements. Each of the input vectors $y_0$ to $y_T$ contains a sampled period of a presumed quasiperiodic signal. This sampled signal is typically time warped to allow for variations of quasiperiodic periods, so that each input vector contains the same number of elements, as will be apparent to a person skilled in the art. Alternatively, consecutive input vectors $y_0$ to $y_T$ may have elements added to them or removed from them, again so that the resulting number of elements in each is the same. For an nth iteration, an input vector $y_n$ will be applied to vector input 3 and estimator vector input 19. The digital filter 2 processes this input vector $y_n$ resulting in the slowly evolving filter estimate output 6 providing, to input 13, the previous filtered estimate vector $x_{f,n-1}$ of a slowly evolving component of sequence of vectors $y_0$ to $y_T$.

The parameter estimator 10 processes the previous filtered estimate value $x_{f,n-1}$ and current input vector $y_n$ to provide a current current predictor gain vector $\alpha_n$ at predictor output 11. The current predictor gain vector an is thereby applied to input 4 of the digital filter 2 for controlling the gain thereof during filtering of input vector $y_n$. The parameter estimator 10 determines the current predictor gain element values $\alpha_{n,i}$ for the current predictor gain vector $\alpha_n$ by the calculation stated in equation (7b).

As will be apparent to a person skilled in the art, at initialisation (i.e. the first sample time when n is 0 therefore input vector $y_0$ is applied to digital filter system 1), there will be no previous filtered estimate element values $x_{f,n-1,i}$. Accordingly, although there are many ways to allocate values for the previous filtered estimate values $x_{f,n-1,i}$, the present invention preferably assigns the previous filtered estimate values $x_{f,n-1,i}$ with the same element values as input vector $y_0$.

Figure 5:
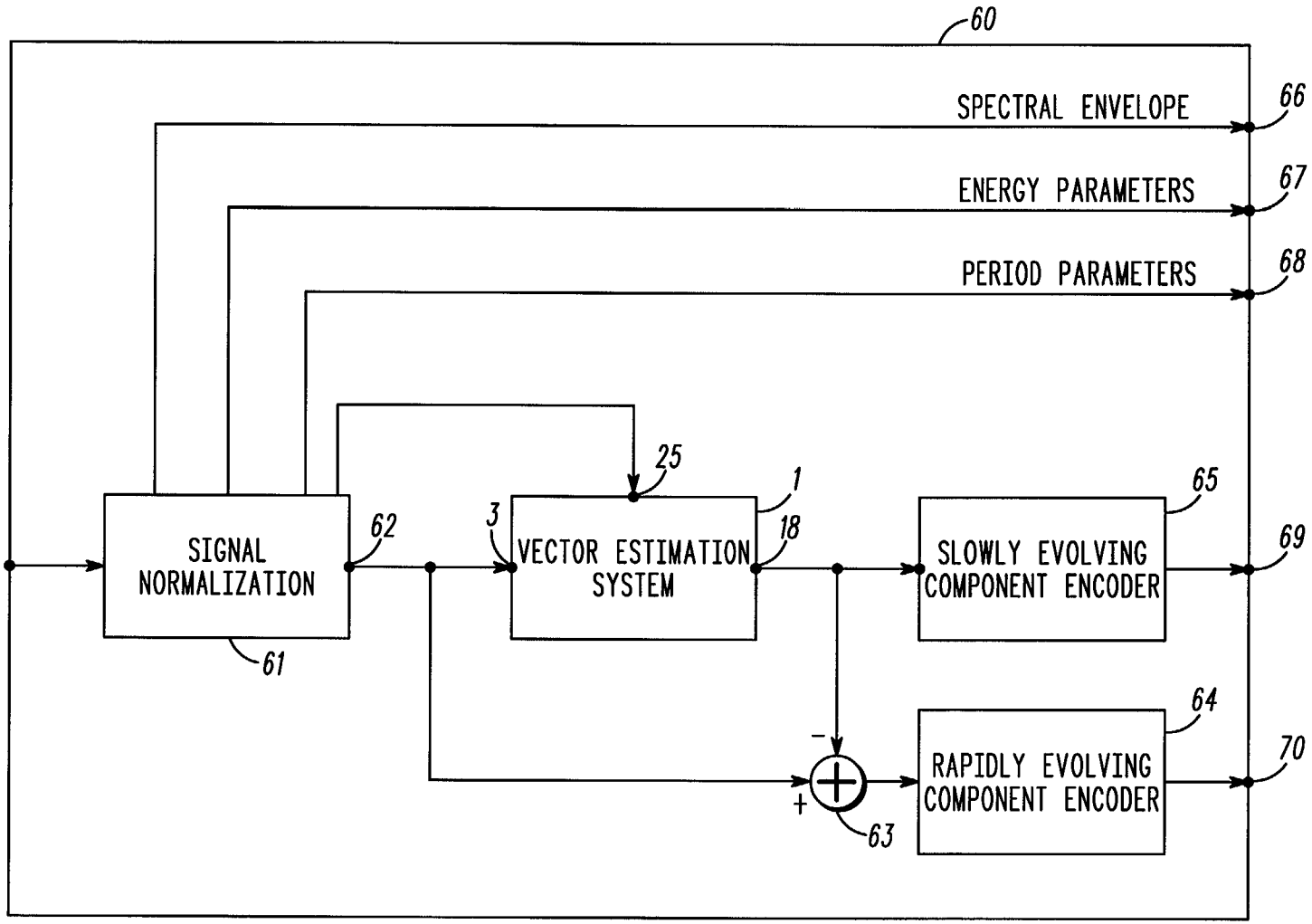
FIG. 5 illustrates a speech encoder that includes the vector estimation system of FIG. 1.

Referring to FIG. 5, the vector estimation system 1 can advantageously be included in a speech encoder 60. The speech encoder 60 includes a signal normalization module 61 with an input for receiving a speech signal. A signal vector output 62 of the signal normalization module 61 is coupled to filter vector input 3 and another output is coupled to the process noise variance input 25 of the vector estimation system 1. The signal vector output 62 is also coupled to an input of an adder module 63 and another input of the adder module 63 is coupled to the smoothed estimate output 18 of the vector estimation system 1. An output from the adder module 63 is coupled to an input of a rapidly evolving component encoder 64 and there is also a slowly evolving component encoder 65 having an input coupled to the smoothed estimate output 18. The speech encoder 60 has three outputs from the signal normalization module 61, for coupling to a speech decoder, these outputs being a spectral envelope output 66, an energy parameters output 67 and a period parameters output 68. The speech encoder 60 also has a slowly evolving component output 69 from the slowly evolving component encoder 65 and a rapidly evolving component output 70 from the rapidly evolving component encoder 64.

In operation, the speech encoder 60 firstly normalizes a speech signal with respect to its spectral envelope, energy and period. The normalisation process involves estimating parameters that describe the spectral envelope, energy and period of the input signal and these parameters are typically transmitted to a speech decoder at outputs 66, 67, 68. The process noise variance provided at the process noise variance input 25 is typically used to control the vector estimation system 1. The normalisation process produces the sequence of input vectors ($y_0$ to $y_T$) for the vector estimation system 1. The sequence of input vectors ($y_0$ to $y_T$) are a sequence of fixed length vectors representing sampled consecutive cycles of the normalised waveform. These vectors ($y_0$ to $y_T$) are applied to the filter vector input 3 of the vector estimation system 1, which generates a slowly evolving component at the smoothed estimate output 18. By subtracting this slowly evolving component from the input vectors ($y_0$ to $y_T$) a rapidly evolving, or noise-like component is produced and provided to the rapidly evolving component encoder 64. The slowly evolving and rapidly evolving components are encoded respectively by the slowly and rapidly evolving component encoders 65, 64,. The encoders 64, 65 use appropriate methods known in the art to produce parameters at respective outputs 70, 69 which are transmitted to a speech decoder.

Advantageously, the present invention provides for the vector estimation system 1 to receive the current input vector $y_n$ that is one of the sequence of input vectors $y_0$ to $y_T$. The parameter estimator 10 then provides the current predictor gain element values $\alpha_{n,i}$, at the predictor gain output 11, thereby modifying the current filtered estimate element values $x_{f,n,i}$ at the slowly evolving filter estimate output 6 (see equations (1) and (2)). The current predictor gain element values $\alpha_{n,i}$ are dependent upon the previous filtered estimate vector $x_{f,n-1}$ and the current input vector $y_n$ (see equations (7b) and (9)) As will be apparent to a person skilled in the art, the parameter estimator 10 determines the current predictor gain element values $\alpha_{n,i}$ from both a sequence of input vectors $y_n$ to $y_0$ and a sequence of previous filtered estimate vectors $x_{f,0}$ to $x_{f,n-1}$.

The present invention also advantageously allows for the parameter estimator 10 to provide the current observation noise variance values $\sigma_{v_n,i}^2$ at the observation noise variance output 12, thereby modifying current filtered estimate element values $x_{f,n,i}$ at the slowly evolving filter estimate output 6 (see equations (2) and (3)). The current observation noise variance element values $$\sigma_{v_n,i}^2$$

are dependent upon the current input vector $y_n$, the current predictor gain element vector $\alpha_n$, the current predictor error variance vector $\Sigma_{p,n}$, and the previous filtered estimate vector $x_{f,n-1}$ (see equations ((10a), (10b) and (8b)).

The detailed description provides a preferred exemplary embodiment only, and is not intended to limit the scope, applicability, or configuration of the invention. Rather, the detailed description of the preferred exemplary embodiment provides those skilled in the art with an enabling description for implementing a preferred exemplary embodiment of the invention. It should be understood that various changes may be made in the function and arrangement of elements without departing from the spirit and scope of the invention as set forth in the appended claims.

I claim:

1. A system for processing a sequence of input vectors, said input vectors each comprising a plurality of element values, and said system comprising:

a digital filter with a filter vector input for receiving said sequence of input vectors obtained from a digitized speech signal and a predictor gain input for controlling characteristics of said filter, said digital filter also having both a current slowly evolving filter estimate output and a previous slowly evolving filter estimate output, said current slowly evolving filter estimate output providing a current filtered estimate vector of current filtered estimate element values of a slowly evolving component of said sequence of input vectors and said previous slowly evolving filter estimate output providing a previous filtered estimate vector of previous filtered estimate element values of said slowly evolving component of said sequence of input vectors;

a parameter estimator having an estimator vector input for receiving said sequence of input vectors and a previous slowly evolving filter estimate input coupled to said previous slowly evolving filter estimate output, said parameter estimator further includes, a predictor gain output coupled to said predictor gain input;

a smoother module having inputs coupled respectively to at least two outputs of said digital filter, said smoother module having a smoothed estimate output providing a smoothed estimate value of a said previous slowly evolving component; and a slowly evolving component encoder with an input coupled to said smoothed estimate output, wherein when said system receives a current input vector that is one of said sequence of said input vectors, said parameter estimator provides a current predictor gain vector of current predictor gain element values at said predictor gain input each of said current predictor gain element values modifying both one of said current filtered estimate element values at said current slowly evolving filter estimate output and said smoothed estimate value, each of said current predictor gain element values being dependent upon both a said previous filtered estimate vector received at said slowly evolving filter estimate input and a said current input vector received at said estimator vector input, and wherein the slowly evolving component encoder processes said smoothed estimate value to provide a digitized encoded slowly evolving component of the speech signal.

2. A system as claimed in claim 1, wherein said parameter estimator is characterised by said current predictor gain element values being dependent upon both a sequence of previous input vectors and a sequence of said previous filtered estimate vectors.

3. A system as claimed in claim 1, wherein said filter has a predictor error variance output and an observation noise variance input, said predictor error variance output providing a current predictor error variance vector of current predictor error variance element values.

4. A system as claimed in claim 1, wherein when said vector estimation system receives said current input vector, said parameter estimator provides a current observation noise variance vector of current observation noise variance element values at said observation noise variance output thereby modifying said current filtered estimate element values at said current slowly evolving filter estimate output, said current observation noise variance element values being dependent upon a said previous filtered estimate vector received at said previous slowly evolving filter estimate input, said current input, vector received at said estimator vector input, a said current predictor gain vector and a said current predictor error variance vector.

5. A as claimed in claim 1, wherein the parameter estimator has an unvoiced speech module that determines the current input vector's harmonic energy content by assessing the current predictor gain element values and depending upon the current predictor gain element values the parameter estimator selectively sets the current observation noise variance values.

6. A system for processing a sequence of input vectors, said input vectors each comprising a plurality of element values, and said system comprising:

a digital filter with a filter vector input for receiving said sequence of input vectors obtained from a digitized speech signal and an observation noise variance input for controlling characteristics of said filter, said digital filter also having a current slowly evolving filter estimate output, a predictor error variance output and a previous slowly evolving filter estimate output, said current slowly evolving filter estimate output providing a current filtered estimate vector of current filtered estimate element values of a slowly evolving component of said sequence of input vectors, said predictor error variance output providing a current predictor error variance vector of current predictor error variance element values and said previous slowly evolving filter estimate output providing a previous filtered estimate vector of previous filtered estimate element values of said slowly evolving component of said sequence of input vectors;

a parameter estimator having an estimator vector input for receiving said sequence of input vectors and a previous slowly evolving filter estimate input coupled to said previous slowly evolving filter estimate output, said parameter estimator further includes a observation noise variance output coupled to said observation noise variance input and a predictor error variance input coupled to said predictor error variance output;

a smoother module having inputs coupled respectively to at least two outputs of said digital filter, said smoother module having a smoothed estimate output providing a smoothed estimate value of a said previous slowly evolving component; and a slowly evolving component encoder with an input coupled to said smoothed estimate output, wherein when said system receives a current input vector that is one of said sequence of said input vectors, said parameter estimator provides a current observation noise variance vector of current observation noise variance element values at said observation noise variance input each of said current observation noise variance element values modifying both one of said current filtered estimate element values at said current slowly evolving filter estimate output and said smoothed estimate value, each of said current observation noise variance element values being dependent upon said current input vector, said current predictor error variance vector and said previous filtered estimate vector, and wherein the slowly evolving component encoder processes said smoothed estimate value to provide a digitized encoded slowly evolving component of the speech signal.

7. A as claimed in claim 6, wherein the parameter estimator has an unvoiced speech module that determines the current input vector's harmonic energy content by assessing the current predictor gain element values and depending upon the current predictor gain element values the parameter estimator selectively sets the current observation noise variance values.

8. A as claimed in claim 6, wherein said digital filter further includes:

a slowly evolving predicted estimate output providing a current predicted estimate vector of current predicted estimate element values of said slowly evolving component of said sequence of input vectors.

9. A system as claimed in claim 6, wherein said smoother module has five inputs coupled to respective outputs of said filter.

10. A system as claimed in claim 6, wherein said smoothed estimate output is coupled to a smoothed estimate input of said parameter estimator.

11. An encoder for processing a digitized speech signal, said encoder comprising:

a signal normalization module for processing the digitized speech signal to provide a sequence of input vectors each comprising a plurality of element values;

a digital filter with a filter vector input coupled to an output of the signal normalization module for receiving said sequence of input vectors, the digital filter also having an observation noise variance input for controlling characteristics of said filter, said digital filter also having a current slowly evolving filter estimate output, a predictor error variance output and a previous slowly evolving filter estimate output, said current slowly evolving filter estimate output providing a current filtered estimate vector of current filtered estimate element values of a slowly evolving component of said sequence of input vectors, said predictor error variance output providing a current predictor error variance vector of current predictor error variance element values and said previous slowly evolving filter estimate output providing a previous filtered estimate vector of previous filtered estimate element values of said slowly evolving component of said sequence of input vectors;

a parameter estimator having an estimator vector input for receiving said sequence of input vectors and a previous slowly evolving filter estimate input coupled to said previous slowly evolving filter estimate output, said parameter estimator further includes a observation noise variance output coupled to said observation noise variance input and a predictor error variance input coupled to said predictor error variance output;

a smoother module having inputs coupled respectively to at least two outputs of said digital filter, said smoother module having a smoothed estimate output providing a smoothed estimate value of a said previous slowly evolving component; and a slowly evolving component encoder with an input coupled to said smoothed estimate output, wherein when said encoder receives a current input vector that is one of said sequence of said input vectors, said parameter estimator provides a current observation noise variance vector of current observation noise variance element values at said observation noise variance input each of said current observation noise variance element values modifying both one of said current filtered estimate element values at said current slowly evolving filter estimate output and said smoothed estimate value, each of said current observation noise variance element values being dependent upon a said current input vector, said current predictor error variance vector and said previous filtered estimate vector, and wherein the slowly evolving component encoder processes said current filtered estimate value to provide a digitized encoded slowly evolving component of the speech signal.

12. An encoder for processing a speech signal as claimed in claim 11, wherein the encoder includes an adder module with one input coupled to said slowly evolving filter estimate output and another input coupled to the output of the signal normalization module, wherein in use said adder subtracts the said current filtered estimate element values at the output of the vector estimation system from at least one of the elements of the sequence of input vectors.

13. An encoder for processing a speech signal as claimed in claim 12, wherein an output of the adder module is coupled to a rapidly evolving component encoder.

14. An encoder for processing a speech signal as claimed in claim 11, wherein said parameter estimator is characterised by said current predictor gain element values being dependent upon both a sequence of previous input vectors and a sequence of filtered estimate vectors.

* * * * *